US009448536B1

(12) United States Patent
Kahn et al.

(10) Patent No.: US 9,448,536 B1
(45) Date of Patent: Sep. 20, 2016

(54) SELF-WINDING MECHANICAL WATCH WITH ACTIVITY TRACKING

(71) Applicant: DP Technologies, Inc., Scotts Valley, CA (US)

(72) Inventors: Philippe Kahn, Santa Cruz, CA (US); Mark Andrew Christensen, Santa Cruz, CA (US); Arthur Kinsolving, Santa Cruz, CA (US)

(73) Assignee: DP TECHNOLOGIES, INC., Scotts Valley, CA (US)

( * ) Notice: Subject to any disclaimer, the term of this patent is extended or adjusted under 35 U.S.C. 154(b) by 0 days.

(21) Appl. No.: 14/639,104

(22) Filed: Mar. 4, 2015

(51) Int. Cl.

| | |
|---|---|
| ***G04B 47/00*** | (2006.01) |
| ***G04B 3/00*** | (2006.01) |
| ***G04B 5/00*** | (2006.01) |
| ***G04B 5/02*** | (2006.01) |
| ***G04B 23/00*** | (2006.01) |
| ***G04B 25/00*** | (2006.01) |
| ***G04B 47/06*** | (2006.01) |
| ***G04B 5/08*** | (2006.01) |

(52) U.S. Cl.
CPC ..... *G04B 47/063* (2013.01); *G04B 5/02* (2013.01); *G04B 5/08* (2013.01); *G04B 47/06* (2013.01)

(58) Field of Classification Search
CPC ..... G04B 47/06; G04B 4/063; G04B 5/02; G04B 5/08
USPC ..... 368/147, 148, 206–208
See application file for complete search history.

(56) References Cited

U.S. PATENT DOCUMENTS

| | | | | |
|---|---|---|---|---|
| 2,082,843 | A * | 6/1937 | Mathez | G04B 27/045 368/192 |
| 3,541,781 | A * | 11/1970 | Bloom | G04F 7/06 368/93 |
| 4,322,609 | A | 3/1982 | Kato | |
| 7,862,226 | B2 * | 1/2011 | Bracher | G04B 27/02 368/190 |
| 2015/0085622 | A1 * | 3/2015 | Carreel | G04B 47/063 368/10 |
| 2015/0289802 | A1 * | 10/2015 | Thomas | A61B 5/4809 600/301 |

FOREIGN PATENT DOCUMENTS

| | | | | |
|---|---|---|---|---|
| CH | 377738 | A * | 1/1964 | G04B 47/06 |
| CH | 668349 | A * | 12/1988 | G04B 47/06 |
| CH | 697528 | B * | 11/2008 | G04B 47/063 |

OTHER PUBLICATIONS

Hans, Translation for CH 377738, Jan. 31, 1964, whole document.*

(Continued)

*Primary Examiner* — Amy Cohen Johnson
*Assistant Examiner* — Daniel Wicklund
(74) *Attorney, Agent, or Firm* — Nicholson De Vos Webster & Elliott LLP

(57) ABSTRACT

An exemplary mechanical watch has a face including an indicator of current time and one or more indicators of physical activity of a wearer of the mechanical watch. The watch further includes a mainspring to store energy and transfer the energy to a balance wheel and gear train to measure the passage of time, a rotor to rotate about a pivot point in response to movements of a wrist of the wearer of the mechanical watch, a rotor gear coupled to the rotor, and an activity-tracking wheel coupled to one of the one or more indicators of physical activity. Movement of the rotor causes the rotor gear to translate the movement of the rotor into winding of the mainspring and into an indication of physical activity of a wearer of the mechanical watch by causing or controlling rotation of the activity-tracking wheel.

12 Claims, 9 Drawing Sheets

(56) References Cited

OTHER PUBLICATIONS

Automatic Winding: Bi-Directional Winding—TimeZone, downloaded at: http://people.timezone.com/library/wglossary/wglossary631693962175676915 on Oct. 29, 2014, 2 pages.

Automatic Winding: The ETA Caliber 2842—TimeZone, downloaded at: http://people.timezone.com/library/wglossary/wglossary631693947620304307 on Oct. 29, 2014, 2 pages.

Automatic Winding: The Jaeger LeCoultre Caliber 889/2—TimeZone, downloaded at: http://people.timezone.com/library/wglossary/wglossary631697075179578367 on Jan. 8, 2015, 2 pages.

How does a self-winding watch work?—HowStuffiWorks, downloaded at: http://www.howstuffworks.com/gadgets/clocks-watches/question285.htm/printable on Jan. 8, 2015, 1 page.

Hacko, Chapter 8: Disassembly of the Automatic Winding System—"The Pump", Nicholas Hacko—Fine Watches, Master Watchmaker, Clockmaker and Jeweller (since 1981), Do It Yourself Project: Seiko 7S26 for Novice Horologists, downloaded at: http://www.clockmaker.com.au/diy_seiko_7s26/chapter8.html on Jan. 13, 2015, 9 pages.

Jones & Horan Auction Team, Prices Realized for Lots 871-912, Oct. 15-16, 2011, downloaded at: http://www.jones-horan.com/1102/html/1102_V.htm on Oct. 29, 2014, 24 pages.

The Ideal Mechanical Watch Movement, downloaded at: http://brainlubeonline.com/watchpage.html on Jan. 9, 2015, 5 pages.

* cited by examiner

SELF-WINDING MECHANICAL WATCH WITH ACTIVITY TRACKING

FIELD OF THE INVENTION

The various embodiments described herein relate to tracking activity. In particular, embodiments described herein relate to a mechanical watch that tracks activity, e.g., to estimate a number of steps taken, an amount of time active, or an amount of time spent sleeping.

BACKGROUND OF THE INVENTION

A mechanical watch typically includes a mainspring, a gear train, a balance wheel, an escapement, and an indicating dial. The mainspring stores mechanical energy for the watch. The gear train transfers the force of the mainspring to the balance wheel and measures the passage of time based upon the movement of the balance wheel. The balance wheel oscillates back and forth, with each swing taking the same amount of time to accurately measure time. The escapement mechanism keeps the balance wheel oscillating back and forth and, with each swing, allows the gear train to advance a set amount. The indicating dial, driven by the gear train, includes hands to display the measured time.

Mechanical watches may include additional functionalities, which are often referred to as complications. Exemplary complications include a chronograph/stopwatch, automatic winding, a power reserve indicator, an alarm, a calendar, etc. For example, a self-winding watch includes an eccentric weight, which rotates about a pivot point in response to movements of the user's wrist. This rotation is translated into the winding of the mainspring, e.g., via one or more gears and a pawl and ratchet arrangement.

BRIEF DESCRIPTION OF THE DRAWINGS

The present invention is illustrated by way of example and not limitation in the figures of the accompanying drawings, in which like references indicate similar elements, and in which.

DETAILED DESCRIPTION

Embodiments described herein include a mechanical watch that tracks activity of a wearer of the watch. For example, embodiments of the mechanical watch estimate a number of steps taken, an amount of time active, or an amount of time spent sleeping. As a result, embodiments described herein provide the functionality of a modern activity tracker in a traditional mechanical watch.

Figure 1:
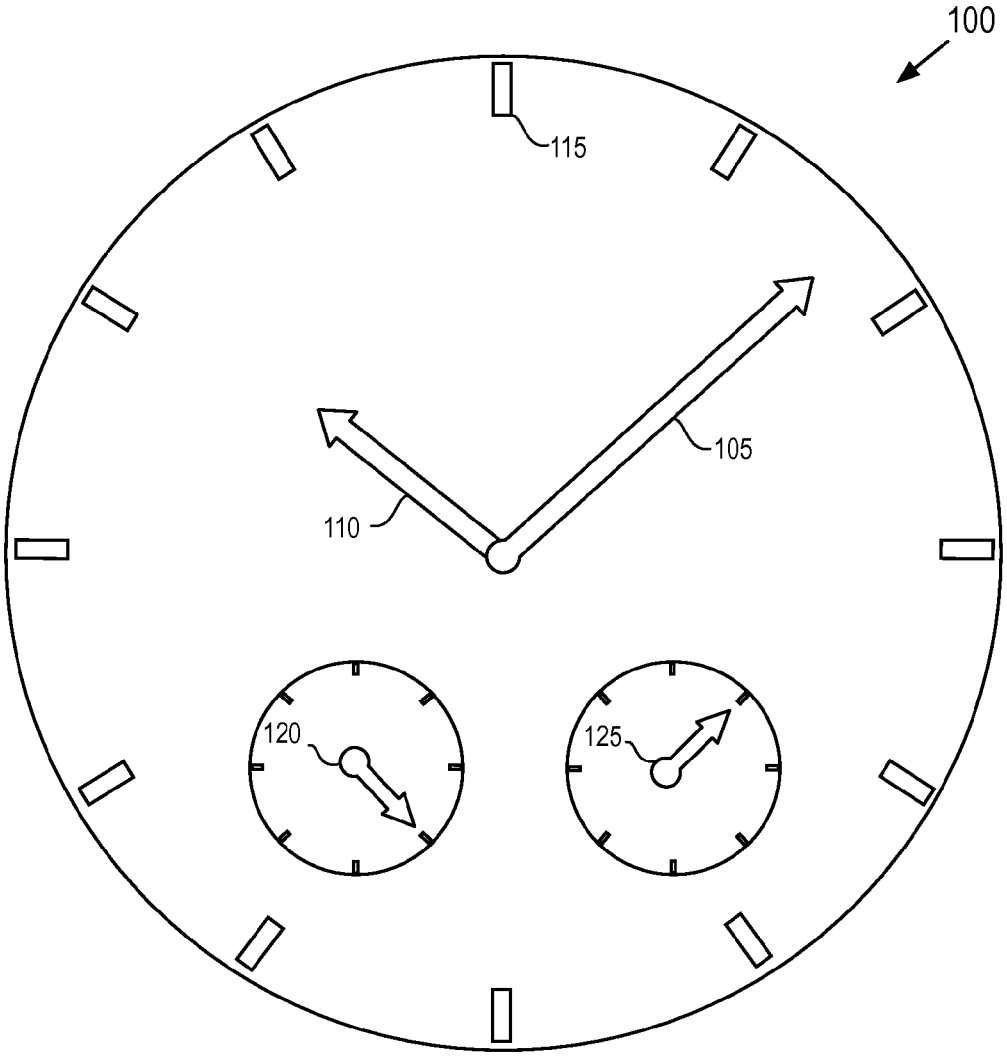
FIG. 1 illustrates a face of a mechanical watch according to an embodiment.

FIG. 1 illustrates exemplary face 100 of a mechanical watch according to an embodiment. Watch face 100 includes minute hand 105, hour hand 110, and demarcations of time 115 to display time as measured by the watch. Watch face 100 further includes one or more indicators of physical activity 120-125. Each of indicators 120-125 includes a hand that points to demarcations of tracked activity within a respective sub-dial. For example, indicator 120 may display an amount of time spent sleeping and indicator 125 may display an estimate a number of steps taken or an amount of time spent active as described further herein. In one embodiment, the demarcations of tracked activity represent ranges based upon recommended daily values. For example, the demarcations of steps may represent a range of zero to ten thousand steps and the demarcations of time spent sleeping may represent a range of zero to eight hours. In one embodiment, the demarcations represent units measured, such as steps taken or hours active or asleep. In another embodiment, the demarcations represent percentages of completion. For example, indicators 120-125 may include demarcations indicating 25%, 50%, 75%, and 100% completion of the goals of steps taken (e.g., a percentage of completion of the goal of taking ten thousand steps) or hours active or asleep (e.g., a percentage of completion of the goal of sleeping eight hours). In another embodiment, a single sub-dial and indicator 120 may be used to track both steps/time active and sleep. For example, as described below, the watch may switch between modes of activity tracking in response to the manipulation of the position of a crown along the axis of winding stem. As such, the movement of the crown may cause indicator 120 to, e.g., reset and switch from representing a tracked number of steps to representing a number of hours asleep or vice versa. In yet another embodiment, one or more indicators of activity tracking are represented within a window. For example, the watch may display within one or more windows a number representing the current day of the month, a symbol representing day (e.g., a sun) or night (e.g., a moon), an alarm setting (e.g., time, on, off, etc.), a step count or percentage of step goal completion, a number representing an estimate of hours active, and/or an estimate of hours asleep or percentage of sleep goal completion.

Figure 2:
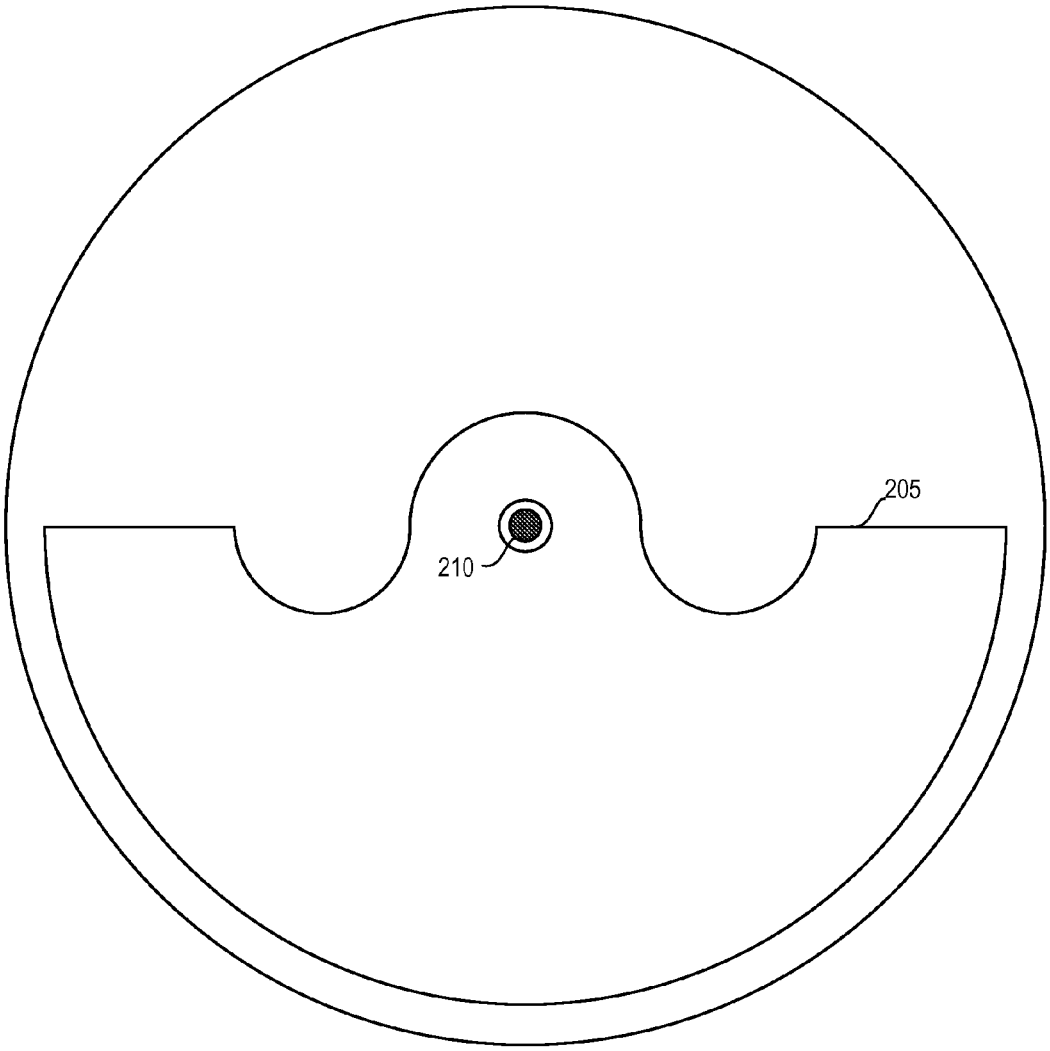
FIG. 2 illustrates an exemplary rotor to rotate about a pivot point in response to movements of a wrist of the wearer of the mechanical watch.

FIG. 2 illustrates exemplary rotor 205 as a partial internal view of an embodiment of a mechanical watch. Rotor 205 is an eccentric weight that rotates about pivot point 210 in response to movements of a wrist of the wearer of the mechanical watch. For example, as the watch is rotated or otherwise moved about in space, gravity pulls rotor 205 about pivot point 210. The movement that causes rotor 205 to rotate, as a specific example, may include the natural swinging of an arm as a wearer of the watch walks. In one embodiment, rotor 205 is located on an opposite side of the watch than face 100.

Figure 3:
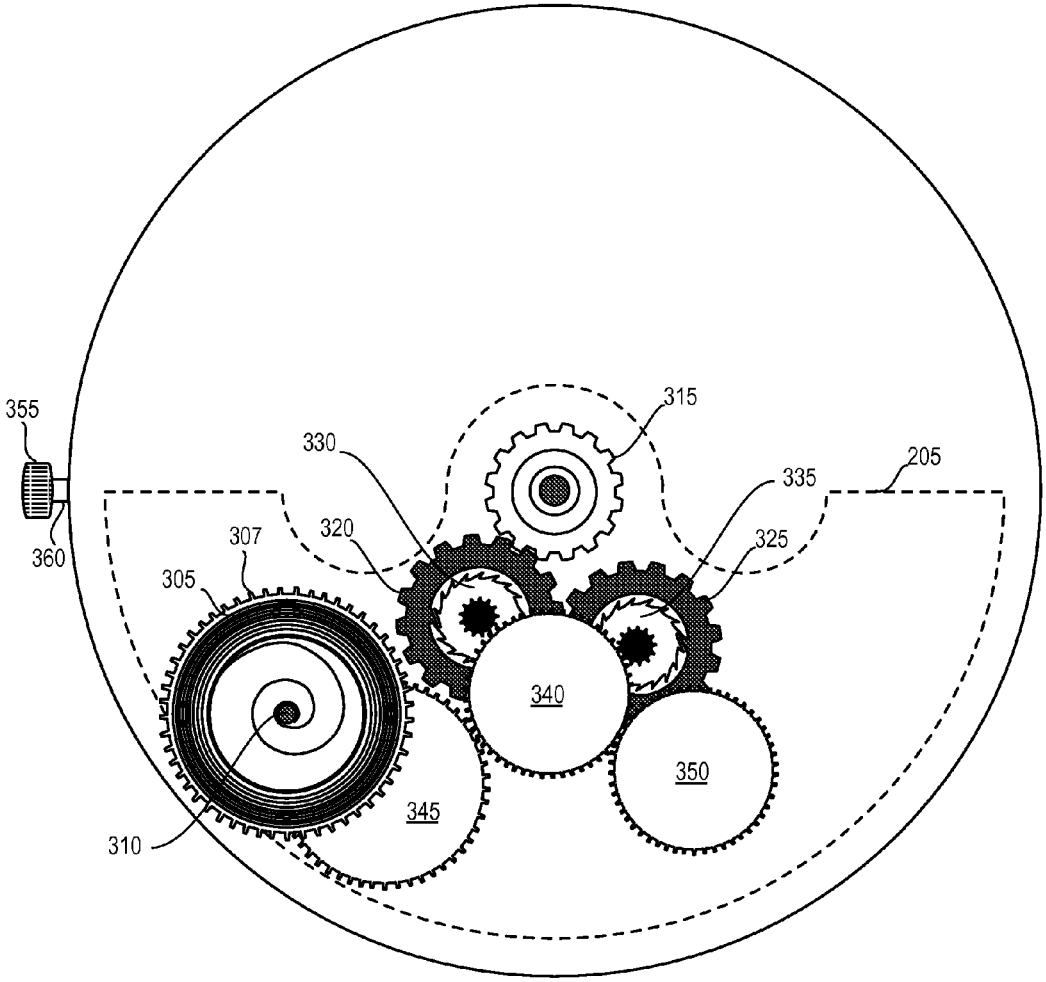
FIG. 3 illustrates an exemplary set of gears to translate movement of the rotor into winding of the mainspring and into an indication of physical activity of a wearer of the mechanical watch.

FIG. 3 illustrates an exemplary set of gears to translate movement of rotor 205 into winding of mainspring 305 and into an indication of physical activity of a wearer of the mechanical watch. For example, these components may be positioned beneath rotor 205. As a result, a dashed line is included to illustrate a transparent representation of rotor 205.

Mainspring 305 powers the watch and includes a spiral ribbon of spring steel inside cylindrical barrel 307. Cylindrical barrel 307 is illustrated with an open face to show mainspring 305, but would typically be enclosed. In one embodiment, one end of mainspring 305 is attached to barrel 307 and the other end of mainspring 305 is attached to arbor 310 about which barrel 307 rotates. Mainspring 305 is wound by rotating arbor 310 and drives the watch movement by rotating barrel 307. As a result, mainspring 305 powers the watch even when being wound. In one embodiment, a pinion (shown in FIG. 7) is attached with a friction fit to the barrel (rather than via meshed gears) to allow the pinion to slide, e.g., when setting the hands. Mainspring 305 drives a gear train (illustrated in and described with reference to FIG. 7), as controlled by a balancing wheel and escapement (not shown), to control the position of minute hand 105 and hour hand 110.

Rotor 205 is coupled to rotor gear 315 such that rotor gear 315 rotates as rotor 205 rotates. Rotor gear 315 is engaged with a winding gear arrangement. In one embodiment, the winding gear arrangement is a bi-directional gear arrangement that translates rotation of the rotor in each of both rotational directions into a single direction of rotation of an intermediate gear to wind mainspring 305. For example, the winding gear arrangement may include two outer gears 320-325, two inner gears 330-335 within outer gears 320-325, and rotor drive gear 340. Inner gears 330-335 are ratchet gears with sloped teeth and each includes a smaller pinion gear attached to one side. The interior of each of outer gears 320-325 includes ratchet pawls to enable outer gears 320-325 to operate as a one-way clutch. The teeth of rotor gear 315 mesh with the teeth of outer gear 320. When outer gear 320 is rotated counter-clockwise by the clockwise movement of rotor gear 315, one or more ratchet pawls on the interior of outer gear 320 cause inner gear 330 to rotate as well. This counter-clockwise rotation of inner gear 330 causes, via the pinion attached to inner gear 330, rotor drive gear 340 to rotate in a clockwise direction. When rotor gear 315 rotates counter-clockwise, outer gear 320 will turn clockwise. Given the sloped teeth of inner gear 330, the clockwise rotation of outer gear 320 will not engage inner gear 330. However, the teeth of outer gear 320 mesh with the teeth of outer gear 325. The clockwise rotation of outer gear 320 rotates outer gear 325 counter-clockwise. When outer gear 325 is rotated counter-clockwise, one or more ratchet pawls on the interior of outer gear 325 cause inner gear 335 to rotate counter-clockwise as well. This rotation of inner gear 335 causes rotor drive gear 340 to rotate in a clockwise direction. As a result, rotation of rotor gear 315 in both clockwise and counter-clockwise directions results in clockwise rotation of rotor drive gear 340. Rotor drive gear 340, directly or indirectly via one or more intermediate gears (e.g., intermediate gear 345), rotates arbor 310 and winds mainspring 305.

In an alternate embodiment, the mechanical watch includes a different winding gear arrangement. For example, the watch may use pawl levers to push and pull a gear, a switching rocker, or another configuration to implement bi-direction winding or single directional winding (and corresponding rotation of rotor drive gear 340).

In one embodiment, rotor drive gear 340 drives one or more additional gears. For example, rotor drive gear 340 may cause or control rotation of activity-tracking wheel(s) coupled to indicator(s) of physical activity 120/125. As illustrated, rotor drive gear 340 is engaged with gear 350. As described with reference to the embodiments herein, gear 350 may be a part of a sliding gear assembly, vertical clutch, or other gear arrangement that enables gear 350 to be moved between engagement with rotor drive gear 340 and disengagement with rotor drive gear 340. Various embodiments of tracking activity using the output of rotor drive gear 340 are described with further reference to FIGS. 4-12.

Embodiments of the watch further include crown 355 coupled to winding stem 360. Crown 355 and winding stem 360 are rotatable around the axis of winding stem 360 to implement one or more functionalities dependent on a position of crown 355 as moved along the axis of winding stem 360. For example, winding stem 360 is coupled to a clutch and one or more pinions (not shown). As crown 355 and winding stem 360 are pulled away from or pushed into the watch, one or more levers engage or disengage the pinion(s) such that rotation of crown 355 and winding stem 360 functions to, e.g., wind mainspring 305 or set the time by rotating hands 105-110. In one embodiment, a position of crown 355 along the axis of winding stem 360 enables one or more activity-tracking modes. For example, as described further herein, the position of crown 355 along the axis of winding stem 360 may cause a lever to engage a gear with rotor drive gear 340, a gear with a gear within the gear train, an inactivity timer wheel with a gear within the gear train, rotate a column wheel and/or locking lever, etc. In an alternate embodiment, the mechanical watch includes a secondary stem (e.g., not used for winding mainspring 305) or button to enable one or more the activity-tracking modes described herein. In one embodiment, a mode in which the watch tracks activity is entered, exited, or otherwise triggered in response to setting or turning on/off an alarm. For example, the manipulation of a stem or button may cause the watch to both turn on an alarm and enter a sleep tracking mode. As another example, the manipulation of a stem or button may cause the mechanical watch to both turn off an alarm and exit a sleep tracking mode. As described above, in one embodiment, entering a sleep tracking mode may also result in exiting a step (or other activity) tracking mode and exiting a sleep tracking mode may also result in entering the step (or other activity) tracking mode.

Figure 4:
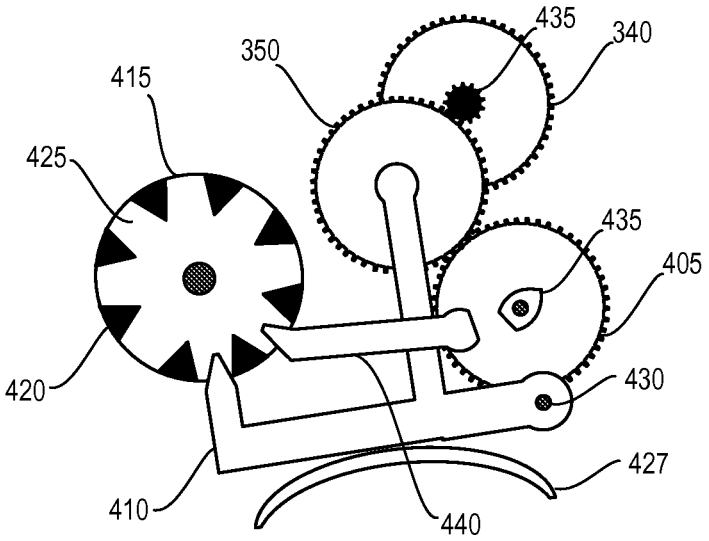
FIGS. 4-5 illustrate two positions of an exemplary sliding gear assembly to engage and disengage an activity-tracking wheel from the rotor.
Figure 5:
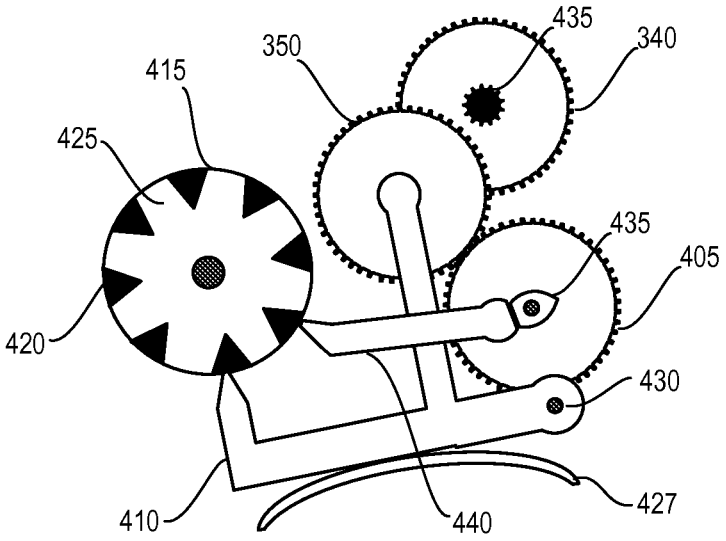

FIGS. 4-5 illustrate two positions of an exemplary sliding gear assembly to engage and disengage activity-tracking wheel 405 from rotor 205. The sliding gear assembly includes engagement lever 410 coupled to gear 350. Column wheel 415 includes vertical columns 420 and gaps 425 between vertical columns 420. As column wheel 415 rotates, one end of engagement lever 410 is moved between resting within a gap 425 and resting on an outer surface of a vertical column 420. In one embodiment, this end of engagement lever 410 is urged in the direction of column wheel 415 by spring 427 and the rotation of column wheel 415 moves engagement lever 410 in the opposite direction, about pivot point 430, by overcoming the force of spring 427.

For example, FIG. 4 illustrates one end of engagement lever 410 resting within a gap 425. In this position, the end of engagement lever coupled to gear 350 is positioned such that gear 350 is engaged with rotor drive gear 340 (e.g., via pinion 435). As rotor drive gear 340 rotates, engaged gear 350 drives activity-tracking wheel 405. For example, as the wearer of the watch walks, rotor 205 rotates rotor gear 315, rotor gear 315 in turn rotates rotor drive gear 340 as described above, and activity-tracking wheel 405, engaged via gear 350, rotates indicator 125 as an indication of steps taken by the wearer. In one embodiment, an indicator 125 is coupled to activity-tracking wheel 405 via a common axle.

In one embodiment, the ratio of gears between rotor gear 315 and activity-tracking wheel 405 is selected to correspond to a correlation between movement of rotor 205 and steps taken. For example, data may be collected by a sample pool of users wearing both an electronic activity tracker, such as an activity tracker powered by Motion X®, and a mechanical watch including a gear assembly to measure rotations of a rotor (or to measure rotations of a gear driven by rotations of a rotor). Using the data of the sample pool, a correlation is determined between steps taken as measured by the electronic activity tracker (or other accurate activity tracker) and rotations of the rotor as measured by the mechanical watch. Based upon the correlation, the gearing ratio is selected such that a number of rotations of the rotor 205 rotate an activity-tracking wheel a corresponding amount to indicate the estimate of the number of steps taken by the wearer.

In one embodiment, activity-tracking wheel 405 is reset to zero in response to manual input or automatically in response to a time of the day. For example, column wheel 415 may rotate in response to user manipulation of a button or winding stem 360 or in response to a gear within the gear train reaching a particular position. In one embodiment, column wheel 415 rotates in response to the gear/wheel coupled to hour hand 110 rotating to a position corresponding to midnight.

Upon rotation of column wheel 415, one end of engagement lever 410 travels from a gap 425 to a resting position on a vertical column 420, as illustrated in FIG. 5. In this resting position, the end of engagement lever coupled to gear 350 is positioned such that gear 350 is disengaged with rotor drive gear 340. As a result, activity-tracking wheel 405 may be reset without being rotated by and without affecting rotor drive gear 340.

In one embodiment, activity-tracking wheel 405 is reset by a hammer or lever pressing against a cam attached to activity-tracking wheel 405. For example, upon rotation of column wheel 415, one end of hammer 440 travels from a gap 425 to a resting position on a vertical column 420. As a result, the other end of hammer 440 is pressed against heart-shaped cam 435 attached to activity-tracking wheel 405, which returns activity-tracking wheel 405 to a position in which activity indicator 125 attached to activity-tracking wheel 405 is returned to zero. Similar to engagement lever 410, hammer 440 is urged in the direction of column wheel 415 by a spring (not shown) and the rotation of column wheel 415 moves hammer 440 in the opposite direction, about pivot point (not shown), by overcoming the force of the spring.

In one embodiment, column wheel 415 is rotated incrementally such that engagement lever 410 and hammer 440 each respectively travel from one gap 425 to another gap 425. As a result, activity-tracking wheel 405 is disengaged from rotor drive gear 340, activity-tracking wheel 405 (and activity indicator 125) is reset to zero, and activity-tracking wheel 405 is reengaged with rotor drive gear 340, all in a single motion of column wheel 415.

In an alternate embodiment, activity-tracking wheel 405 (or gear 350) is a part of a vertical clutch that enables activity-tracking wheel 405 to be moved between engagement with rotor drive gear 340 and disengagement with rotor drive gear 340. Similarly, other sliding gear arrangements described herein may be implemented by a vertical clutch.

Figure 6:
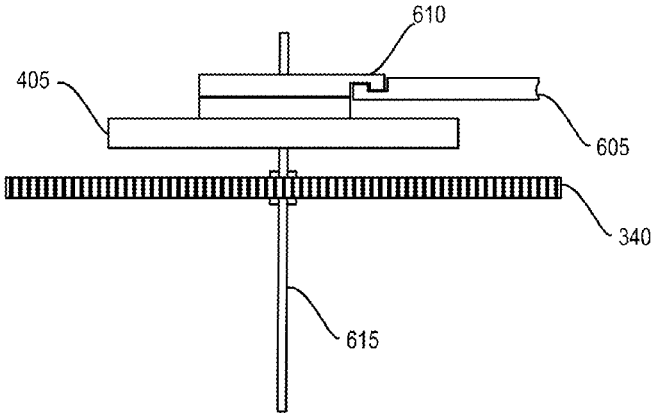
FIG. 6 illustrates an exemplary vertical clutch to engage and disengage an activity-tracking wheel from the rotor.

FIG. 6 illustrates an exemplary vertical clutch to engage and disengage activity-tracking wheel 405. The vertical clutch is a spring-loaded disk assembly. Similar to the description of FIG. 5, lever 605 may be moved in response to the rotation of a column wheel. Lever 605 rotates in and out of engagement with disk 610. When lever 605 engages with disk 610, the rotation and shape of the mating portions of lever 605 and disk 610 compress the spring and lift activity-tracking wheel 405 along axle 615 and away from rotor drive gear 340. Once separated, rotor drive gear 340 may continue rotating while activity-tracking wheel 405 is free to be reset (e.g. using a cam as described above). When lever 605 disengages with disk 610, the spring-loaded mechanism urges activity-tracking wheel 405 back down axle 615 and into contact with rotor drive gear 340. The friction between activity-tracking wheel 405 and rotor drive gear 340 results in rotations of rotor drive gear 340 translating into rotations of activity-tracking wheel 405.

Figure 7:
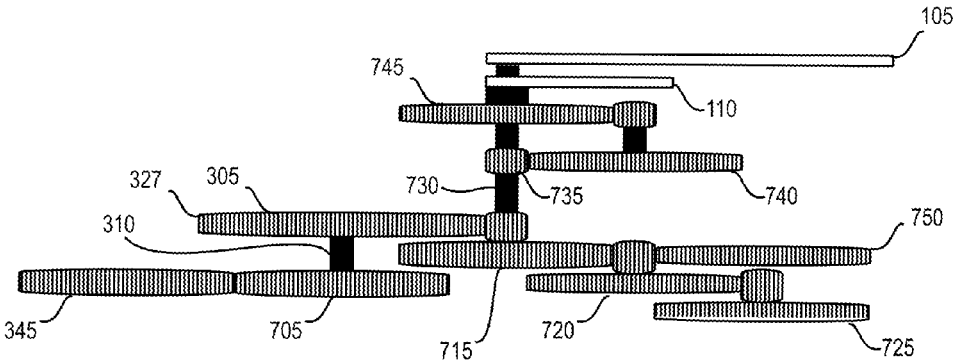
FIG. 7 illustrates an exemplary gear train to drive minute and hour hands, a time-based reset of an activity-tracking wheel, and activity time recording.

FIG. 7 illustrates an exemplary gear train to drive minute hand 105, hour hand 110, a time-based reset of an activity-tracking wheel, and activity time recording. As described above, intermediate gear 345 rotates arbor 310, via pinion 705, to wind mainspring 305. Mainspring 305 rotates barrel 327. In turn, barrel 327 rotates center wheel 715, third wheel 720, and fourth wheel 725. Fourth wheel 725 engages with an escapement mechanism and balance wheel (not shown) that control the pace of the rotation of the gears within the gear train. Center wheel 715 is coupled to axle 730 and axle 730 is coupled to minute hand 105. As center wheel 715 rotates, so does minute hand 105 to measure time in minutes. Similarly, through gear reduction via pinion 735 and intermediate gear 740, hour wheel 745 rotates hour hand 110 to measure time in hours.

In one embodiment, the mechanical watch tracks a cumulative amount of time the wearer of the watch is active or asleep. For example, the time may be recorded in minutes. As described further herein, the time elapsed while the wearer is active or while the wearer is asleep is recorded by engaging and disengaging a gear with the gear train. For example, similar to gear 350, one or more gears 750 may be engaged with center wheel 715, the pinion of third wheel 720, or another gear within gear train (directly or via one or more intermediate gears) utilizing a gear ratio such that gear 750 is able to drive activity indicator 120/125 at a rotational speed that corresponds to minutes/hours active/asleep. Additionally, as described further below, one or more gears within the gear train may be used to drive other functionality of activity tracking components.

Figure 8:
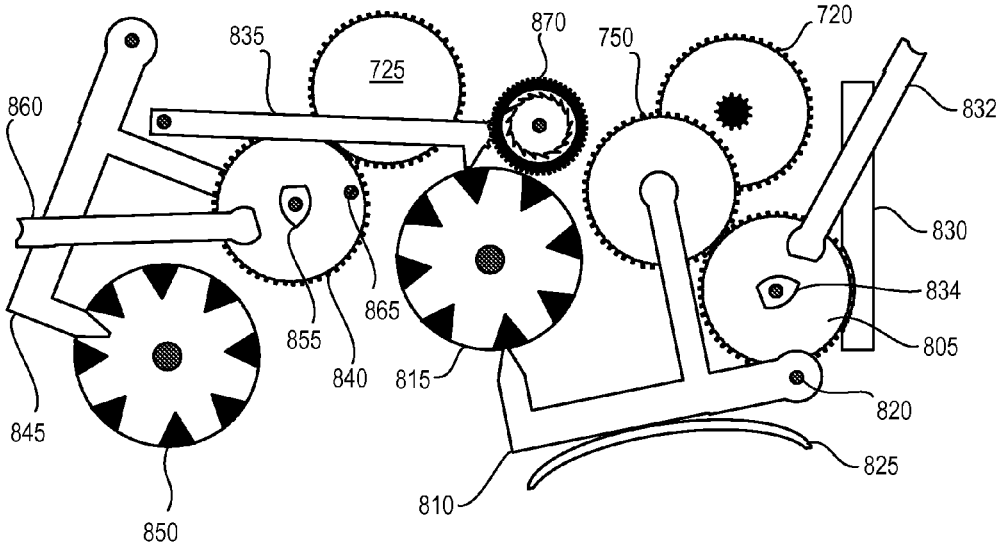
FIGS. 8-9 illustrate an exemplary set of components to track an estimate of an amount of time a wearer of the mechanical watch is active based upon time elapsed when the rotor is active.
Figure 9:
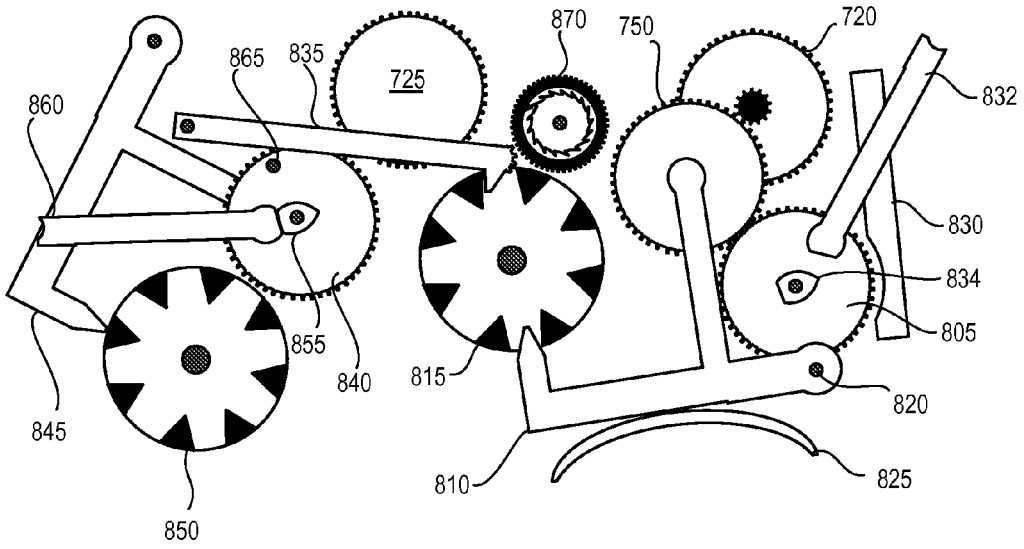

FIGS. 8-9 illustrate an exemplary set of components to track an estimate of an amount of time a wearer of the mechanical watch is active based upon time elapsed when the rotor is active. Similar to the description of FIGS. 4-5, the mechanical watch may employ a sliding gear assembly, vertical clutch, or other gear arrangement to enable gear 750 (or active time recording wheel 805) to be moved between engagement and disengagement with third wheel 720 (or another gear within or coupled to the gear train). In the illustrated example, a sliding gear assembly includes engagement lever 810 coupled to gear 750. Depending upon the position of column wheel 815, engagement lever 810 rotates about pivot point 820 to move gear 750 into and out of engagement with third wheel 720. For example, one end of engagement lever 810 is urged in the direction of column wheel 815 by spring 825 and the rotation of column wheel

815 moves engagement lever 810 in the opposite direction, about pivot point 820, by overcoming the force of spring 825.

In one embodiment, rotation of column wheel 815 is driven by rotor drive gear 340 such that movement of rotor 205 is translated into the initiation or resuming of tracking time during which the wearer of the watch is active. Column wheel 815 is rotated incrementally such that engagement lever 810 travels from resting on a column (as illustrated in FIG. 8) to resting within a gap (as illustrated in FIG. 9) or from resting within a gap to resting on a column. For example, in response to movement of rotor 205, column wheel 815 rotates from the position illustrated in FIG. 8 to the position illustrated in FIG. 9. As a result, the movement of engagement lever 810 engages active time recording wheel 805 with the gear train (e.g., via gear 750 and third wheel 720) to record time when the wearer is active by rotating indicator 120/125. In one embodiment, an indicator 120/125 is coupled to active time recording wheel 805 via a common axle. For example, when active time recording wheel 805 is engaged with third wheel 720, active time recording wheel 805 rotates indicator 120/125 at the same pace as minute hand 105 to record cumulative active time in minutes.

In one embodiment, brake lever 830 prevents active time recording wheel 805 from rotating when disengaged from the gear train. For example, brake lever 830 may be urged against active time recording wheel 805 (as illustrated in FIG. 8) by a spring (not shown) and released from time active time recording wheel 805 (as illustrated in FIG. 9) in response to the rotation of column wheel 815 in a manner similar to engagement lever 810. For the sake of a simplified illustration, however, only a portion of brake lever 830 is illustrated. As a result, when a wearer of the watch is inactive and active time recording is paused, brake lever 830 holds active time recording wheel 805 and indicator 125 in the paused position until active time recording is resumed.

In one embodiment, active time recording wheel 805 is reset by hammer or lever 832 pressing against cam 834 attached to active time recording wheel 805. In one embodiment, active time recording wheel 805 is reset to zero in response to manual input or automatically in response to a time of the day. For example, similar to the description of FIGS. 4-5, a column wheel (not shown) may rotate in response to user manipulation of a button or winding stem or in response to a gear within the gear train reaching a particular position. In one embodiment, active time recording wheel 805 is reset to zero in response to the wheel coupled to hour hand 110 (e.g., hour wheel 745) rotating to a position corresponding to midnight.

In one embodiment, lock 835 is urged (e.g., by a spring) into a gap between columns when column wheel 815 rotates. For example, the incremental rotation of column wheel described above results in an end of lock 835 traveling from resting on a column of column wheel 815 (as illustrated in FIG. 8) to resting within a gap (as illustrated in FIG. 9). As a result, during the recording of active time by wheel 805, lock 835 prevents subsequent movements of rotor 205 from rotating column wheel 815 and interrupting the time recorded by active time recording wheel 805. For example, column wheel 815 may be driven by rotor drive gear 340 (or an intermediate gear directly or indirectly coupled to rotor drive gear 340) via friction or in a manner that otherwise allows lock 835 to prevent column wheel 815 from rotating despite the corresponding rotation(s) of rotor drive gear 340.

While lock 835 prevents subsequent rotations of rotor 205 from interrupting the time recorded by active time recording wheel 805 during continued movement, the mechanical watch unlocks column wheel 815 in response to inactivity of the wearer. In one embodiment, lock 835 is released in response to a threshold amount of time passing without a threshold amount of rotation of rotor 205. For example, mechanical watch may include inactivity timer wheel 840. Inactivity timer wheel 840 is coupled to engagement arm 845 and moved between engagement and disengagement with a gear within or coupled to the gear train (e.g., fourth wheel 725) in a similar manner to the other sliding gear arrangements described herein. For example, rotation of column wheel 850 is driven by rotor drive gear 340 such that a threshold amount of movement of rotor 205 is translated into engaging or disengaging inactivity timer wheel 840 with fourth wheel 725.

Similar to the description of FIGS. 4-5, inactivity timer wheel 840 is reset by hammer 860 (only illustrated in part) or another lever pressing against cam 855 attached to inactivity timer wheel 840. For example, upon rotation of column wheel 850, one end of hammer 860 travels from a gap to a resting position on a vertical column (or vice versa). The other end of hammer 860 is pressed against heart-shaped cam 855 attached to inactivity timer wheel 840, which resets inactivity timer wheel 840. Similar to engagement lever 845, hammer 860 may be urged in the direction of column wheel 850 by a spring (not shown) and the rotation of column wheel 850 moves hammer 860 in the opposite direction, about pivot point (not shown), by overcoming the force of the spring. As a result, each continued movement of rotor 205 resets inactivity timer wheel 840, allowing the recording of active time by wheel 805 to continue.

In one embodiment, column wheel 850 is rotated incrementally such that engagement lever 845 and hammer 860 each respectively travel from one gap to another gap in one incremental movement of column wheel 850. As a result, inactivity timer wheel 840 is disengaged from fourth wheel 725, inactivity timer wheel 840 is reset, and inactivity timer wheel 840 is reengaged with fourth wheel 725, all in a single motion of column wheel 850 caused by rotation of rotor 205.

In one embodiment, inactivity timer wheel 840 causes the release of lock 835 from column wheel 815. For example, inactivity timer wheel 840 may include pin 865 (or another raised feature) that is capable of moving lock 835 when inactivity timer wheel 840 is rotated into a corresponding position. For example, when engaged with fourth wheel 725, inactivity timer wheel 840 rotates and pin 865 on a surface of inactivity timer wheel 840 rotates from a reset position (shown in FIG. 9) in a counter-clockwise direction. If movement of rotor 205, and the corresponding rotation of column wheel 850, does not reset inactivity timer wheel 840, pin 865 collides with lock 835 and moves lock 835 such that the locking end of lock 835 is removed from the gap in column wheel 815.

In one embodiment, the unlocking of column wheel 815 causes an incremental rotation of column wheel 815. For example, an end of lock 835 may include gear teeth to engage with one-way gear 870. As pin 865 lifts lock 835, the teeth of lock 835 rotate the outer portion of one-way gear 870 in a clockwise direction. One or more ratchet pawls on the interior of the outer gear of one-way gear 870 cause the inner gear of one-way gear 870 to rotate as well. The rotation of the inner gear of one-way gear 870, in turn, rotates column wheel 815. Alternatively, lock 835 shares an axle with a gear (not shown) and that engages with one-way gear 870 (or another one-way clutch) such that rotation of lock 835 results in rotation of the gear and corresponding rotation of column wheel 815. As a result, lock 835 comes to rest on a column of column wheel 815 and movements of rotor 205 may rotate column wheel 815 again. Additionally, the rotation of column wheel 815 due to inactivity causes the sliding gear assembly to disengage activity time recording wheel 805 from third wheel 720, pausing the recording of active time until rotor 205 moves again. When lock 835 returns to a position within a gap of column wheel 815, however, the corresponding counter-clockwise rotation of the outer gear of one-way gear 870 does not engage the inner gear of one-way gear 870.

Figure 10:
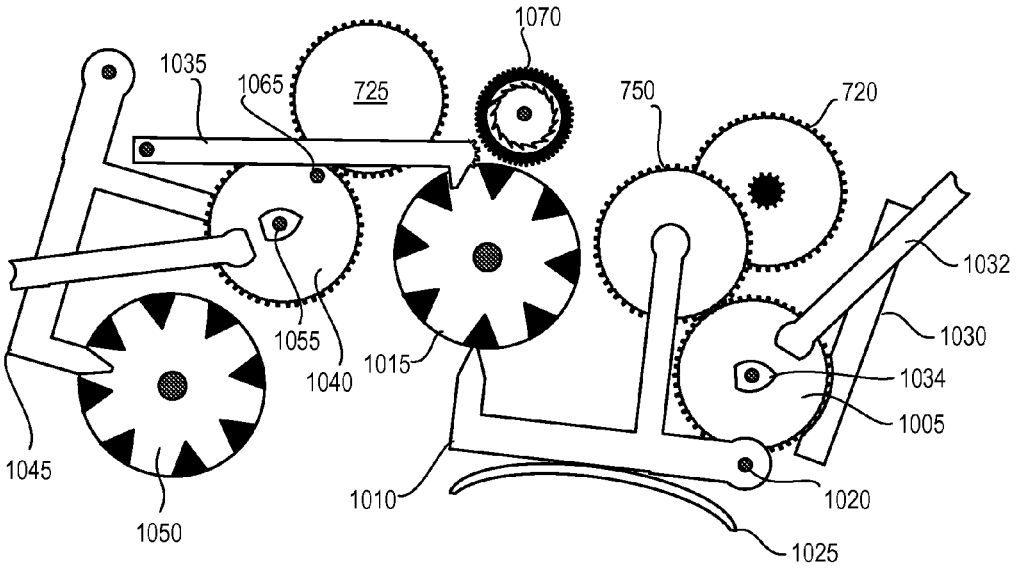
FIGS. 10-11 illustrate an exemplary set of components to track an estimate of an amount of time a wearer of the mechanical watch is asleep based upon time elapsed when the rotor is inactive.
Figure 11:
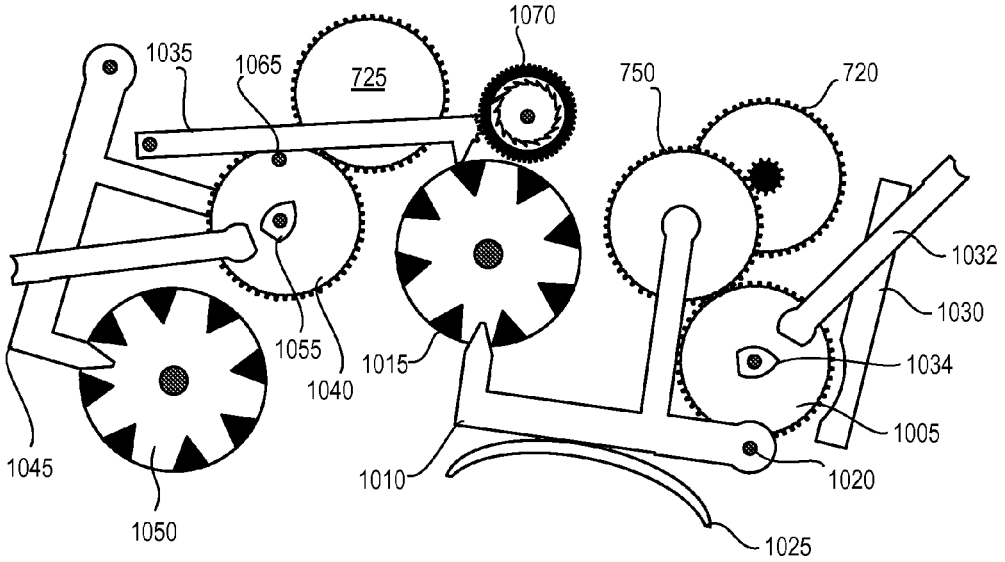

FIGS. 10-11 illustrate an exemplary set of components to track an estimate of an amount of time a wearer of the mechanical watch is asleep based upon time elapsed when the rotor is inactive. Similar to the description of FIGS. 8-9, the mechanical watch may employ a sliding gear assembly, vertical clutch, or other gear arrangement to enable gear 750 (or sleep time recording wheel 1005 or another intermediate gear) to be moved between engagement and disengagement with third wheel 720 (or another gear within or coupled to the gear train). In the illustrated example, a sliding gear assembly includes engagement lever 1010 coupled to gear 750. Depending upon the position of column wheel 1015, engagement lever 1010 rotates about pivot point 1020 to move gear 750 into and out of engagement with third wheel 720. For example, one end of engagement lever 1010 is urged in the direction of column wheel 1015 by spring 1025 and the rotation of column wheel 1015 moves engagement lever 1010 in the opposite direction, about pivot point 1020, by overcoming the force of spring 1025.

In one embodiment, rotation of column wheel 1015 is driven by rotor drive gear 340 such that movement of rotor 205 is translated into pausing the of tracking time during which the wearer of the watch is asleep. Column wheel 1015 is rotated incrementally such that engagement lever 1010 travels from resting on a column (as illustrated in FIG. 10) to resting within a gap (as illustrated in FIG. 11) or from resting within a gap to resting on a column. As a result, the movement of engagement lever 1010 engages sleep time recording wheel 1005 with the gear train (e.g., via gear 750 and third wheel 720) to record time when the wearer is asleep by rotating indicator 120. In one embodiment, indicator 120 is coupled to sleep time recording wheel 1005 via a common axle. For example, when sleep time recording wheel 1005 is engaged with third wheel 720, sleep time recording wheel 1005 rotates indicator 120 at the same pace as minute hand 105 to record cumulative sleep time in minutes.

In one embodiment, brake lever 1030 prevents active sleep recording wheel 1005 from rotating when disengaged from the gear train. For example, brake lever 1030 may be urged against sleep time recording wheel 1005 (as illustrated in FIG. 10) by a spring (not shown) and released from sleep time recording wheel 1005 (as illustrated in FIG. 11) in response to the rotation of column wheel 1015 in a manner similar to engagement lever 1010. For the sake of a simplified illustration, however, only a portion of brake lever 1030 is illustrated. As a result, when a wearer of the watch is active and sleep time recording is paused, brake lever 1030 holds sleep time recording wheel 1005 and indicator 120 in the paused position until the wearer of the watch is inactive and sleep time recording is resumed.

In one embodiment, sleep time recording wheel 1005 is reset by hammer or lever 1032 pressing against cam 1034 attached to active time recording wheel 1005. In one embodiment, active time recording wheel 1005 is reset to zero in response to manual input. For example, similar to the description above, a column wheel (not shown) may rotate in response to user manipulation of a button or winding stem 360. Alternatively, user manipulation of a button or winding stem 360 may directly move lever 1032. In one embodiment, sleep time recording wheel 1005 is reset in response to crown 355 and winding stem 360 being pulled or pushed into a sleep mode position and/or rotation of crown 355 and winding stem 360.

In one embodiment, lock 1035 is urged (e.g., by a spring) into a gap between columns when column wheel 1015 rotates. For example, the incremental rotation of column wheel 1015 described above results in an end of lock 1035 traveling from resting on a column of column wheel 815 (as illustrated in FIG. 11) to resting within a gap (as illustrated in FIG. 10). As a result, when activity pauses the recording of sleep time by wheel 1005, lock 1035 prevents subsequent movements of rotor 205 from rotating column wheel 1015 and resuming the time recorded by sleep time recording wheel 1005. For example, column wheel 1015 may be driven by rotor drive gear 340 (or an intermediate gear directly or indirectly coupled to rotor drive gear 340) via friction or in a manner that otherwise allows lock 1035 to prevent column wheel 1015 from rotating despite the corresponding rotation(s) of rotor drive gear 340.

In one embodiment, lock 1035 is released in response to a threshold amount of time passing without a threshold amount of rotation of rotor 205. For example, the mechanical watch may include inactivity timer wheel 1040. Inactivity timer wheel 1040 is coupled to engagement arm 1045 and moved between engagement and disengagement with a gear within or coupled to the gear train (e.g., fourth wheel 725) in a similar manner to the other sliding gear arrangements described herein. For example, rotation of column wheel 1050 is driven by rotor drive gear 340 such that a threshold amount of movement of rotor 205 is translated into engaging or disengaging inactivity timer wheel 1040 with fourth wheel 725.

Similar to the description of FIGS. 8-9, inactivity timer wheel 1040 is reset by hammer 1060 (only illustrated in part) or another lever pressing against cam 1055 attached to inactivity timer wheel 1040. For example, upon rotation of column wheel 1050, one end of hammer 1060 travels from a gap to a resting position on a vertical column (or vice versa). The other end of hammer 1060 is pressed against heart-shaped cam 1055 attached to inactivity timer wheel 1040, which resets inactivity timer wheel 1040. As a result, continued movement of rotor 205 resets inactivity timer wheel 840, allowing the recording of time asleep by wheel 1005 to continue to be paused. Similar to engagement lever 1045, hammer 1060 may be urged in the direction of column wheel 1050 by a spring (not shown) and the rotation of column wheel 1050 moves hammer 1060 in the opposite direction, about pivot point (not shown), by overcoming the force of the spring.

In one embodiment, column wheel 1050 is rotated incrementally such that engagement lever 1045 and hammer 1060 each respectively travel from one gap to another gap in one incremental movement of column wheel 1050. As a result, inactivity timer wheel 1040 is disengaged from fourth wheel 725, inactivity timer wheel 1040 is reset, and inactivity timer wheel 1040 is reengaged with fourth wheel 725, all in a single motion of column wheel 1050.

In one embodiment, inactivity timer wheel 1040 causes the release of lock 1035 from column wheel 1015. For example, inactivity timer wheel 1040 may include pin 1065 (or another raised feature) that is capable of moving lock 1035 when inactivity timer wheel 1040 is rotated into a corresponding position. For example, when engaged with fourth wheel 725, inactivity timer wheel 1040 rotates and pin 1065 on a surface of inactivity timer wheel 1040 rotates from a reset position in a counter-clockwise direction. If movement of rotor 205, and the corresponding rotation of column wheel 1050, does not reset inactivity timer wheel 1040, pin 1065 collides with lock 1035 and moves lock 1035 such that the locking end of lock 1035 is removed from the gap in column wheel 1015 (as shown in FIG. 11). In one embodiment, setting the mechanical watch into sleep mode (e.g., via manipulation of crown 355) unlocks column wheel 1015.

In one embodiment, the unlocking of column wheel 1015 causes an incremental rotation of column wheel 1015. For example, an end of lock 1035 may include gear teeth to engage with one-way gear 1070. As pin 1065 lifts lock 1035, the teeth of lock 1035 rotate the outer portion of one-way gear 1070 in a clockwise direction. One or more ratchet pawls on the interior of the outer gear of one-way gear 1070 cause the inner gear of one-way gear 1070 to rotate as well. The rotation of the inner gear of one-way gear 1070, in turn, rotates column wheel 1015. Alternatively, lock 1035 shares an axle with a gear (not shown) and that engages with one-way gear 1070 (or another one-way clutch) such that rotation of lock 1035 results in rotation of the gear and corresponding rotation of column wheel 1015. As a result, lock 1035 comes to rest on a column of column wheel 1015 and movements of rotor 205 may rotate column wheel 1015 again. Additionally, the rotation of column wheel 1015 due to inactivity causes the sliding gear assembly to engage sleep time recording wheel 1005 with third wheel 720, starting or resuming the recording of time asleep until rotor 205 moves again. When lock 1035 returns to a position within a gap of column wheel 1015, however, the corresponding counter-clockwise rotation of the outer gear of one-way gear 1070 does not engage the inner gear of one-way gear 1070.

Figure 12:
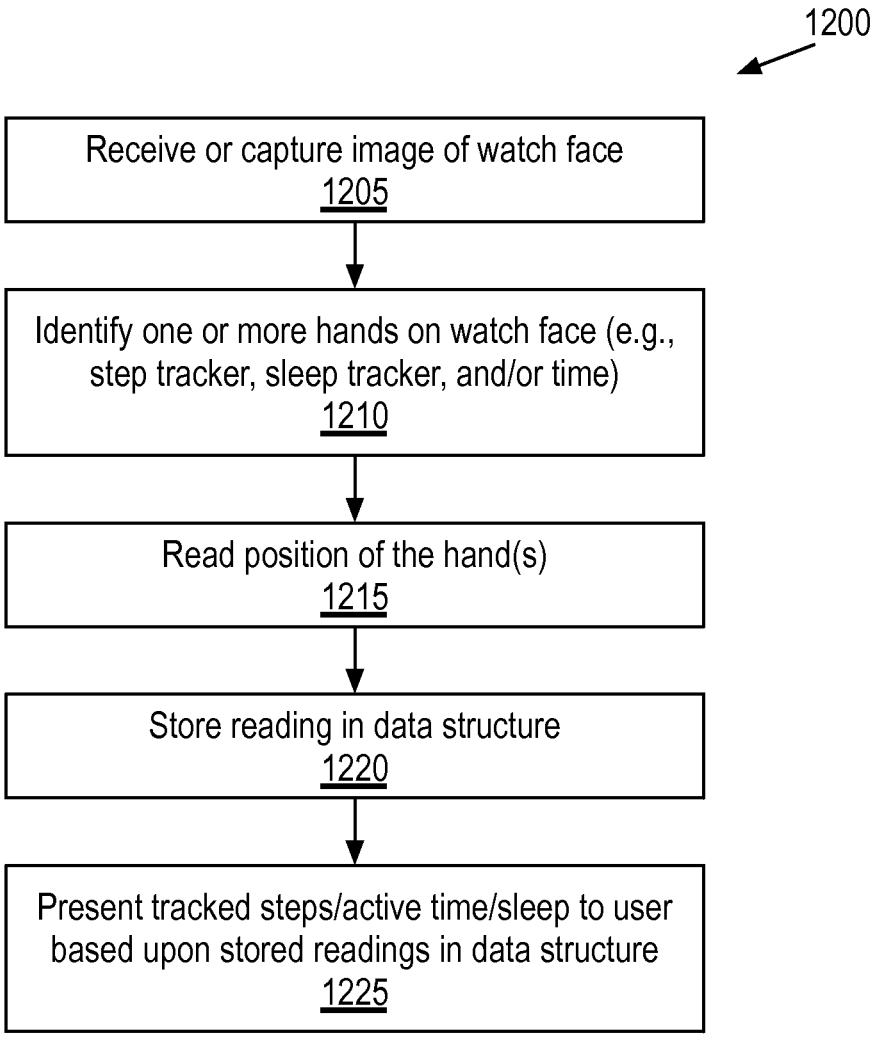
FIG. 12 is a flow chart illustrating an exemplary method of a processing system identifying, storing, and presenting activity tracked by the mechanical watch.

FIG. 12 is a flow chart illustrating exemplary method 1200 of a processing system identifying, storing, and presenting activity tracked by the mechanical watch. For example, the wearer of the watch may use a mobile phone or other personal computing device to track steps, time during which the wearer is active, or sleep.

At block 1205, the computing device receives or captures an image of watch face 100. For example, a user may position a mobile phone camera to capture or receive an image of watch face 100 while running a software program implementing method 1200. In response to recognizing a watch face or receiving user input, the mobile phone camera captures the image.

At block 1210, the computing device identifies one or more hands on watch face 100. For example, the computing device utilizes an object recognition program to identify indicators 120 and 125. In one embodiment, the computing device also identifies minute hand 105 and hour hand 110. For example, the computing device may use the positions of minute hand 105 and hour hand 110 and a current time tracked by the computing device to determine the orientation of watch face 100. Alternatively, the computing device uses the relative positions of pivot points of indicators 120 and 125 within watch face 100 to determine the orientation of watch face 100. In one embodiment, the computing device also identifies demarcations of time 115 and/or demarcations of activity around indicators 120 and 125.

At block 1215, the computing device reads the position of the hands/indicators. For example, based upon a determined orientation of watch face 100 (using the relative positions of pivot points of indicators 120 and 125 within watch face 100) or based upon the recognition of the demarcations of activity around indicators 120 and 125, the computing device determines a value associated with the position of indicator 120 and/or indicator 125 in the image of watch face 100. In one embodiment, the computing device determines the top of the sub-dial(s) associated with indicator 120 and/or indicator 125 (e.g., the position normally associated with twelve o'clock on a watch or clock). Using the example above of a range of zero to ten thousand steps, indicator 125 may point to zero steps at a position normally associated with twelve o'clock, to 2,500 steps at a position normally associated with three o'clock, to 5,000 steps at a position normally associated with six o'clock, to 7,500 steps at a position normally associated with nine o'clock, and corresponding values in between. The computing device determines the relative position of indicator 120 and/or indicator 125 within the respective sub-dial(s) and maps that position to a corresponding value. For example, in FIG. 1, indicator 125 is pointing to a demarcation between the positions normally associated with twelve o'clock and three o'clock. As such, the computing device would determine indicator 125 has a current reading of 1,250 steps.

In one embodiment, the computing device utilizes a previous reading of indicator 120 and/or indicator 125 in the determining of the current reading of indicator 120 and/or indicator 125. For example, if the user is very active and takes more than 10,000 steps, indicator 125 may make more than a complete rotation of the corresponding sub-dial. If the computing device determines a previous reading of indicator 125 (within a threshold period of time, e.g., the same day) to be further along in clockwise rotation than the current reading, the computing device determines that indicator 125 has made a complete rotation. For example, if the computing device read indicator 125 a couple of hours earlier in the day as indicating the wearer of the watch had taken 7,500 steps and a current image of watch face 100 corresponds to the illustration of FIG. 1, the computing device would determine indicator 125 has a current reading of 11,250 steps.

At block 1220, the computing device stores the reading of indicator 120 and/or indicator 125 in memory. For example, previous readings may be used as described above. Additionally, the computing device may evaluate and/or compile readings to create reports and feedback for the user.

At block 1225, the computing device presents tracked steps, active time, or sleep time to the user based upon the stored readings. For example, the computing device may compare daily readings against readings history, goals, recommended values, etc. to generate reports, recommendations, etc.

Figure 13:
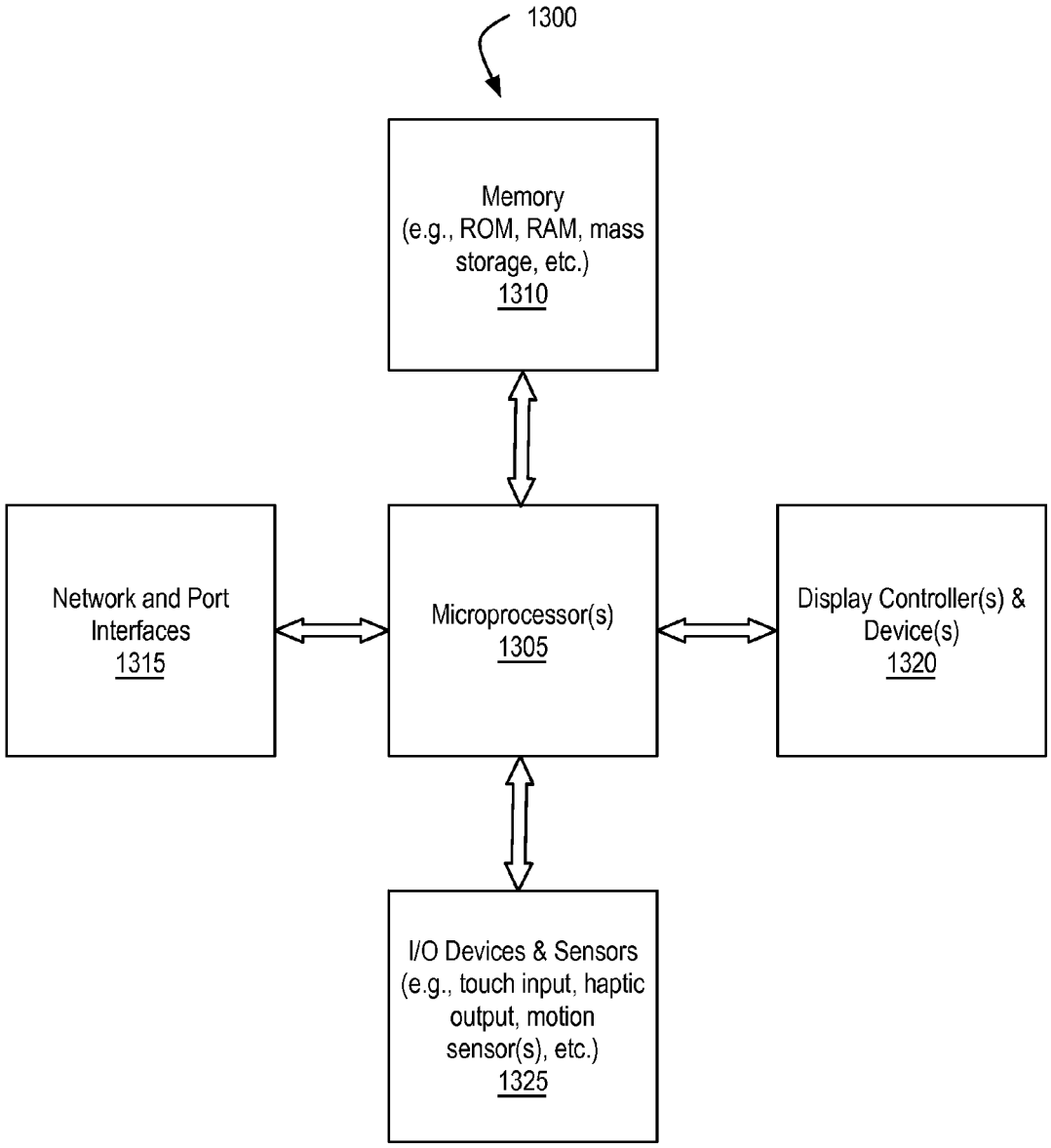
FIG. 13 illustrates, in block diagram form, an exemplary processing system to identify, store, and present activity tracked by the mechanical watch.

FIG. 13 illustrates, in block diagram form, exemplary processing system 1300 to identify, store, and present activity tracked by the mechanical watch. Data processing system 1300 includes one or more microprocessors 1305 and connected system components (e.g., multiple connected chips). Alternatively, data processing system 1300 is a system on a chip.

Data processing system 1300 includes memory 1310, which is coupled to microprocessor(s) 1305. Memory 1310 may be used for storing data, metadata, and programs for execution by the microprocessor(s) 1305. Memory 1310 may include one or more of volatile and non-volatile memories, such as Random Access Memory ("RAM"), Read Only Memory ("ROM"), a solid state disk ("SSD"), Flash, Phase Change Memory ("PCM"), or other types of data storage. Memory 1310 may be internal or distributed memory.

Data processing system 1300 includes network and port interfaces 1315, such as a port, connector for a dock, or a connector for a USB interface, FireWire, Thunderbolt, Ethernet, Fibre Channel, etc. to connect the system 1300 with another device, external component, or a network. Exemplary network and port interfaces 1315 also include wireless transceivers, such as an IS 802.11 transceiver, an infrared transceiver, a Bluetooth transceiver, a wireless cellular telephony transceiver (e.g., 2G, 3G, 4G, etc.), or another wireless protocol to connect data processing system 1300 with another device, external component, or a network and receive stored instructions, data, tokens, etc.

Data processing system 1300 also includes display controller and display device 1320 and one or more input or output ("I/O") devices and sensors 1325. For example, data processing system 1300 may include one or more touch inputs; buttons; one or more inertial sensors, accelerometers, gyroscopes, or a combination thereof; geolocation positioning systems; vibration motors or other haptic feedback devices; etc. In one embodiment, data processing system 1300 includes one or more sensors to track body temperature, heart rate, blood pressure, blood oxygen levels, electrical activity of the heart (electrocardiography), electrical activity of a skeletal muscle (electromyography), acoustic activity (e.g., breathing patterns), skin conductivity (galvanic skin response), and/or another non-invasively tracked biosignal.

Display controller and display device 1320 provides a visual user interface for the user. I/O devices 1325 allow a user to provide input to, receive output from, and otherwise transfer data to and from the system. I/O devices 1325 may include a mouse, keypad or a keyboard, a touch panel or a multi-touch input panel, camera, optical scanner, audio input/output (e.g., microphone and/or a speaker), other known I/O devices or a combination of such I/O devices.

It will be appreciated that one or more buses, may be used to interconnect the various components shown in FIG. 13.

Data processing system 1300 may be a personal computer, tablet-style device, a personal digital assistant (PDA), a cellular telephone with PDA-like functionality, a Wi-Fi based telephone, a handheld computer which includes a cellular telephone, a media player, an entertainment system, a fitness tracker, or devices which combine aspects or functions of these devices, such as a media player combined with a PDA and a cellular telephone in one device. As used herein, the terms computer, device, system, processing system, processing device, and "apparatus comprising a processing device" may be used interchangeably with data processing system 1300 and include the above-listed exemplary embodiments.

It will be appreciated that additional components, not shown, may also be part of data processing system 1300, and, in certain embodiments, fewer components than that shown in FIG. 13 may also be used in data processing system 1300. It will be apparent from this description that aspects of the inventions may be embodied, at least in part, in software. That is, the computer-implemented method 1200 may be carried out in a computer system or other data processing system 1300 in response to its processor or processing system 1305 executing sequences of instructions contained in a memory, such as memory 1310 or other non-transitory machine-readable storage medium. The software may further be transmitted or received over a network (not shown) via network interface device 1315. In various embodiments, hardwired circuitry may be used in combination with the software instructions to implement the present embodiments. Thus, the techniques are not limited to any specific combination of hardware circuitry and software, or to any particular source for the instructions executed by data processing system 1300.

An article of manufacture may be used to store program code providing at least some of the functionality of the embodiments described above. Additionally, an article of manufacture may be used to store program code created using at least some of the functionality of the embodiments described above. An article of manufacture that stores program code may be embodied as, but is not limited to, one or more memories (e.g., one or more flash memories, random access memories—static, dynamic, or other), optical disks, CD-ROMs, DVD-ROMs, EPROMs, EEPROMs, magnetic or optical cards or other type of non-transitory machine-readable media suitable for storing electronic instructions. Additionally, embodiments of the invention may be implemented in, but not limited to, hardware or firmware utilizing an FPGA, ASIC, a processor, a computer, or a computer system including a network. Modules and components of hardware or software implementations can be divided or combined without significantly altering embodiments of the invention.

In the foregoing specification, the invention has been described with reference to specific exemplary embodiments thereof. Various embodiments and aspects of the invention(s) are described with reference to details discussed herein, and the accompanying drawings illustrate the various embodiments. The description above and drawings are illustrative of the invention and are not to be construed as limiting the invention. References in the specification to "one embodiment," "an embodiment," "an exemplary embodiment," etc., indicate that the embodiment described may include a particular feature, structure, or characteristic, but not every embodiment may necessarily include the particular feature, structure, or characteristic. Moreover, such phrases are not necessarily referring to the same embodiment. Furthermore, when a particular feature, structure, or characteristic is described in connection with an embodiment, such feature, structure, or characteristic may be implemented in connection with other embodiments whether or not explicitly described. Additionally, as used herein, the term "exemplary" refers to embodiments that serve as simply an example or illustration. The use of exemplary should not be construed as an indication of preferred examples. Blocks with dashed borders (e.g., large dashes, small dashes, dot-dash, dots) are used herein to illustrate optional operations that add additional features to embodiments of the invention. However, such notation should not be taken to mean that these are the only options or optional operations, and/or that blocks with solid borders are not optional in certain embodiments of the invention. Numerous specific details are described to provide a thorough understanding of various embodiments of the present invention. However, in certain instances, well-known or conventional details are not described in order to provide a concise discussion of embodiments of the present inventions.

It will be evident that various modifications may be made thereto without departing from the broader spirit and scope of the invention as set forth in the following claims. For example, the methods described herein may be performed with fewer or more features/blocks or the features/blocks may be performed in differing orders. Additionally, the methods described herein may be repeated or performed in parallel with one another or in parallel with different instances of the same or similar methods.

What is claimed is:

1. A mechanical watch comprising:

a face including an indicator of current time and one or more indicators of physical activity of a wearer of the mechanical watch;

a mainspring to store energy and transfer the energy to a balance wheel and gear train to measure the passage of time;

a rotor to rotate about a pivot point in response to movements of a wrist of the wearer of the mechanical watch;

a rotor gear coupled to the rotor, wherein movement of the rotor causes the rotor gear to translate the movement of the rotor into winding of the mainspring;

an activity-tracking wheel coupled to a first of the one or more indicators of physical activity, wherein movement of the rotor further causes the rotor gear to translate the movement of the rotor into an indication of physical activity of a wearer of the mechanical watch by causing or controlling rotation of the activity-tracking wheel; and an engagement lever to move between a first position and a second position, wherein the first position of the engagement lever causes the activity-tracking wheel to engage with a gear within the gear train, the first indicator of physical activity records time elapsed while the activity-tracking wheel is engaged with the gear within the gear train, the second position of the engagement lever causes the activity-tracking wheel to disengage with gear within the gear train, and the engagement lever moves from the first position to the second position or from the second position to the first position in response to a passage of an amount of time without movement of the rotor.

2. The mechanical watch of claim 1, wherein the activity-tracking wheel is driven by the rotor gear and a second of the one or more indicators of physical activity represents an estimate of a number of steps taken by the wearer of the mechanical watch.

3. The mechanical watch of claim 1, further comprising:

a cam coupled to the activity-tracking wheel; and a hammer to apply pressure to the cam, wherein the pressure to the cam causes the activity-tracking wheel to return to a reset position.

4. The mechanical watch of claim 3, wherein the hammer applies pressure to the cam in response to a gear within the gear train being in a particular position.

5. The mechanical watch of claim 4, wherein the particular position of the gear corresponds to a position of the gear when the mechanical watch indicates a time of midnight.

6. The mechanical watch of claim 1, further comprising:

a sliding gear assembly coupled to the engagement lever, wherein the movement of the engagement lever between the second position and the first position causes the sliding gear assembly to move and engage the tracking wheel with the gear within the gear train.

7. The mechanical watch of claim 6, wherein the sliding gear assembly includes an intermediate gear between the tracking wheel and the gear within the gear train.

8. The mechanical watch of claim 1, further comprising:

a vertical clutch, wherein the movement of the engagement lever between the second position and the first position releases the vertical clutch enabling the vertical clutch to move and engage the tracking wheel with the gear within the gear train.

9. The mechanical watch of claim 1, wherein:

the engagement lever moves from the second position to the first position in response to movement of the rotor; and the indicator of physical activity coupled to the activity-tracking wheel records time elapsed as an estimate of a cumulative amount of time the wearer of the mechanical watch is physically active.

10. The mechanical watch of claim 1, wherein:

the engagement lever moves from the first position to the second position in response to movement of the rotor; and the indicator of physical activity coupled to the activity-tracking wheel records time elapsed when the rotor is inactive as an estimate of a cumulative amount of time the wearer of the mechanical watch is asleep.

11. The mechanical watch of claim 10, further comprising:

a winding stem, wherein the winding stem is rotatable around an axis and movable along the axis, and wherein moving the winding stem along the axis to a sleep tracking position enables the engagement lever to move from the first position to the second position in response to movement of the rotor.

12. The mechanical watch of claim 1, wherein a second of the one or more indicators of physical activity represents an estimate of a number of steps taken by the wearer of the mechanical watch based upon movement of the rotor, and the first indicator of physical activity records time elapsed when the rotor is inactive as an estimate of a cumulative amount of time the wearer of the mechanical watch is asleep.

* * * * *